US005720499A

United States Patent [19]

Sakashita

[11] Patent Number: 5,720,499

[45] Date of Patent: Feb. 24, 1998

[54] ADHESIVE LABEL

[75] Inventor: Hitoshi Sakashita, Misato, Japan

[73] Assignee: Lintec Corporation, Tokyo, Japan

[21] Appl. No.: 566,393

[22] Filed: Dec. 1, 1995

[30] Foreign Application Priority Data

Dec. 6, 1994 [JP] Japan ..... 6-330052

[51] Int. Cl.[6] ..... B42D 15/00

[52] U.S. Cl. ..... 283/81; 283/105

[58] Field of Search ..... 283/79, 80, 81, 283/101, 103, 105, 900; 40/299, 630; 428/43

[56] References Cited

U.S. PATENT DOCUMENTS 4,430,816 2/1984 Seton et al. .
4,880,964 11/1989 Donahue ..... 283/105 X
4,940,258 7/1990 Cuba, Jr. et al. ..... 283/101 X
5,078,427 1/1992 Ishii et al. ..... 283/81
5,103,583 4/1992 Van Ermen ..... 283/81 X
5,227,209 7/1993 Garland ..... 283/103 X
5,484,167 1/1996 Donaldson et al. ..... 283/81 X

FOREIGN PATENT DOCUMENTS 3-31776 3/1927 Japan .

*Primary Examiner*—Willmon Fridie, Jr.
*Attorney, Agent, or Firm*—Lowe, Price, LeBlanc & Becker

[57] ABSTRACT

An adhesive label includes a label base formed of a translucent resin film, an adhesive layer provided on one surface of the label base, and a release liner attached to the adhesive layer. Slits are formed in the release liner to define an initial release-liner portion and a final release-liner portion. In the state in which the initial release-liner portion is peeled off, the adhesive layer can be partially exposed, and printing is effected on the exposed surface of the adhesive layer.

12 Claims, 4 Drawing Sheets

ADHESIVE LABEL

BACKGROUND OF THE INVENTION

1. Field of the Invention

The present invention relates to an adhesive label, and more particularly to an adhesive label suitable for use when the printing of characters, codes, or the like on an adhesive layer provided on a label base can be effected simply and in real time without requiring a plate-making process.

2. Description of the Related Art

Conventionally, adhesive labels are known in which a predetermined printing is effected on a resin film and which can be attached to various adherends such as boxes. As a conventional structure of such an adhesive label, an arrangement is adopted in which adhesive layers are provided on both surfaces of a base such as paper, a film, or the like, a release liner is attached to the surface of one adhesive layer, printing is effected on the surface of the other adhesive layer by an ink-Jet printer, and a transparent lamination film is attached to that surface (e.g., Japanese Utility Model Application Laid-Open No. 31776/1991).

When the adhesive label is attached to an adherend, the release liner on the side opposite to the printing side is released from the base, and the adhesive layer exposed to the surface is made to adhere to the adherend. Accordingly, since the printed surface is covered with the lamination film, it is possible to effectively avoid the print from becoming peeled off after the label is attached to the adherend. Hence, there is an advantage in that a display effect can be continued stably.

With the above-described adhesive label, however, in the state in which the label is attached to the adherend, the label has the base, the adhesive layers provided on both surfaces of the base, and the lamination film. Thus, there have been drawbacks in that the adhesive label as a whole is provided with a multilayered structure in which the number of component layers is four, and the number of steps of manufacturing the adhesive label unavoidably increases, leading to an increase in the cost of manufacturing the adhesive labels.

In addition, according to the above-described adhesive label having the multilayered structure, there is naturally a limit to making the thickness of the overall adhesive label thin. Accordingly, in the state in which the adhesive label is attached to an adherend, a fixed stepped portion is formed between the surface of the lamination film and the surface of the adherend. As a result, there is a drawback in that the adhesive label is liable to be peeled off due to the adhering strength of the adhesive layer.

Accordingly, the present applicant has trial-manufactured an adhesive label in which the number of layers is substantially reduced while effectively maintaining the existing effects of preventing the peeling off and staining of the printed characters, codes, or the like, so as to simplify the structure and effect a reduction in the manufacturing cost.

However, with the stack sheet type of the above-described adhesive labels, when printing is effected on the adhesive layer, it is necessary to peel the release liner off the adhesive layer for each adhesive label to cause the entire surface of the adhesive layer to be exposed. For this reason, there arises a need to hold the label base having the adhesive layer by some method, which gives rise to an additional problem in that the structure of a device for realizing the holding is made complicated. Meanwhile, when printing is effected on a multiplicity of adhesive labels provided in the form of elongated sheets, printing is possible without using the aforementioned holding device. In this case, however, there is a drawback in that such adhesive labels are utterly unsuitable for the printing of a few number of sheets, and therefore lacks versatility.

SUMMARY OF THE INVENTION

The present invention has been devised in view of the above-described problems, and its object is to provide an adhesive label which makes it unnecessary to use a special holding device or the like when printing, which makes it possible to print characters, codes, or the like on an adhesive layer provided on a label base, simply and in real time without requiring a plate-making process, and which also has versatility.

To this end, in accordance with the present invention, there is provided an adhesive label which can be adhered to an adherend by placing a printed surface between a surface to be applied and the adherend, the adhesive label comprising: a label base, an adhesive layer provided on one surface of the label base; and a release liner attached to a surface of the adhesive layer, wherein slits are formed in the release liner, and the slits form an initial release-liner portion which allows the one surface and/or the adhesive layer to be exposed by leaving a portion of the release liner.

In this arrangement, as the initial release-liner portion is peeled off, the one surface and/or the adhesive layer is exposed, and printing can be effected on this exposed portion by using a non-contact type printer. At the time of printing, the surface of the label base is brought into contact with the platen of the printer, and feed rollers and the like located in face-to-face relation to the platen are brought into contact with a portion of the release liner left in the partial peeling-off. That is, component parts of the printer are not brought into direct contact with the adhesive layer exposed by the partial peeling-off, and printing is possible by the print head of the non-contact type printer which is located at a position spaced apart from the adhesive layer. After the printing is completed, the portion of the release liner left on the outer side of the adhesive layer is peeled off as a final release-liner portion, thereby making it possible to attach the label base to a predetermined adherend.

In the state in which the label base is attached to the adherend, the printed surface is placed at a position sandwiched by the one surface and/or the adhesive layer, so that the printed surface can always be maintained in a protected state.

The slits can be formed by a continuous cut or perforations. In a case where the release liner is made of paper, the release liner can normally be broken by the use of fingers, but as the slits are formed in advance, the partial peeling-off can always be effected in a fixed area in a routine manner. Additionally, the slits are preferably formed continuously in such a manner as to form a closed loop, which makes it possible to effect the partial peeling-off reliably. Further, as for the slits, it is possible to adopt an arrangement in which a part of the slits projects outside in such a manner as to depict an arc so as to form a tongue for being picked up when the release liner is partially peeling off. As the tongue is formed, the initial position for peeling off the release liner can be specified, and the peeling-off is facilitated by picking up the tongue and pulling it away from the adhesive layer.

As the release liner in the adhesive label, one having a plane area larger than or equivalent to the plane area of the label base. If the release liner has a plane area at least equivalent to that of the label base, the adhesive layer can be provided on the entire area of one surface of the label base.

On the other hand, if the plane area of the release liner is made larger than that of the label base, it is possible to secure a large area for the final release-liner portion which is left after the partial peeling off of the release liner. Accordingly, even if the feed rollers of the printer are located at positions relatively remote from the adhesive layer, the final release-liner portion can be clamped by the platen and the feed rollers.

The label base is formed of a translucent resin sheet, a resin sheet made of an opaque material, or a paper. In a case were the adherend is opaque, characters or the like which are printed on the aforementioned one surface and/or the adhesive layer become invisible due to the adherend, so that the characters or the like are exposed through the label base. Accordingly, in this case, a label base formed of a transparent resin sheet is used, and printing is effected in an inverted state with respect to the left and the right, such that the printed characters or the like are viewed as being positioned characters or the like when seen from the label base side. On the other hand, in a case where the adherend is formed of transparent glass or resin or the like, the printed characters or the like can be exposed through the adherend. Accordingly, whether the printing is to be effected in the inverse state or in the normal state can be determined arbitrarily.

In addition, in accordance with another preferable form of the present invention, there is an adhesive label in which a plurality of label bases are held as a unit. Namely, in accordance with another aspect of the present invention, there is provided an adhesive label which can be adhered to an adherend by placing a printed surface between a surface to be applied and the adherend, the adhesive label comprising: a plurality of label bases, adhesive layers each provided on one surface of each of the label bases; and a release liner for holding in one unit the plurality of label bases respectively attached to the adhesive layers, wherein slits are formed in the release liner, and the slits form an initial release-liner portion which allows the one surface and/or the adhesive layer to be exposed by leaving a portion of the release liner.

According to the above-described arrangement, printing can be effected simultaneously on the aforementioned one surface of each of the plurality of label bases and/or the adhesive layer by using a non-contact type printer. Accordingly, it is possible to improve the efficiency in a case where, for instance, identical contents are printed with respect to a plurality of label bases.

In addition, the slits are preferably formed in a closed loop in such a manner as to planarly straddle two or more label bases. As a result, it is possible to form a plurality of areas subject to printing in a single peeling-off operation.

The above and other objects, features and advantages of the present invention will become more apparent from the following detailed description of the invention when read in conjunction with the accompanying drawings.

DESCRIPTION OF THE PREFERRED EMBODIMENT

Hereafter, a detailed description will be given of an embodiment of the present invention with reference to the accompanying drawings.

Figure 1:
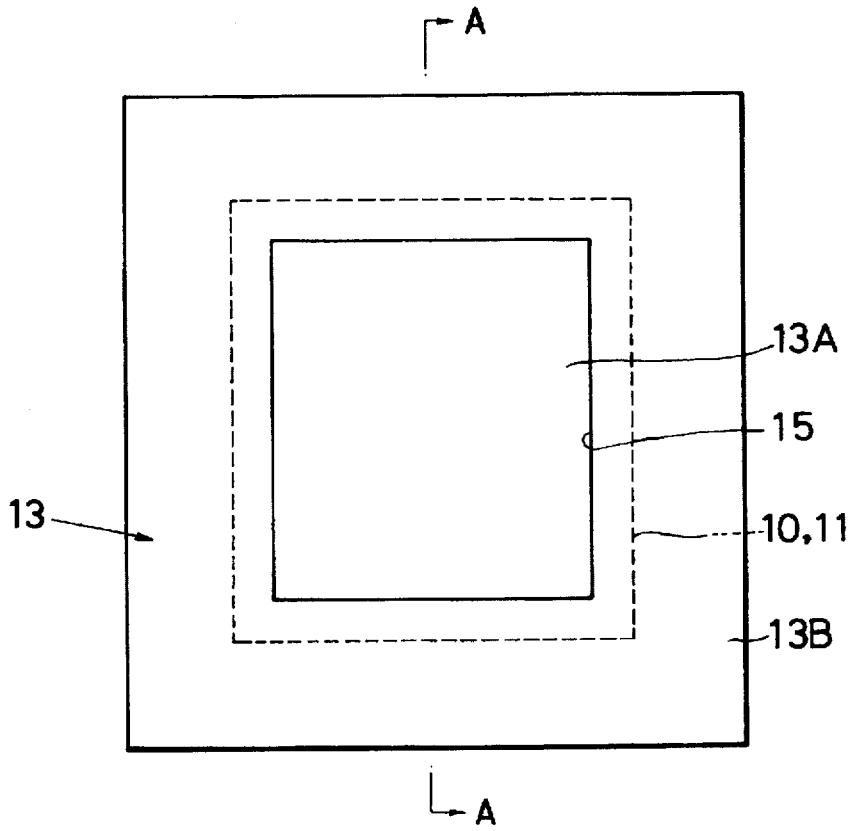
FIG. 1 is a front elevational view illustrating an embodiment of an adhesive label in accordance with the present invention.
Figure 2:
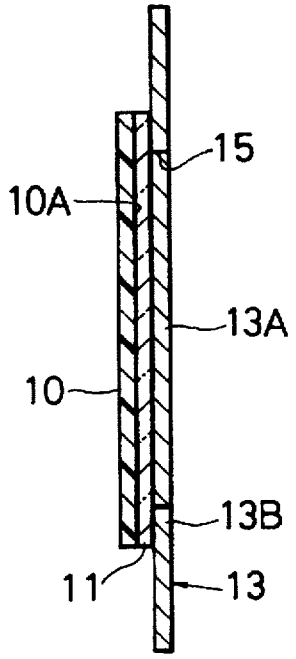
FIG. 2 is a cross-sectional view taken in the direction of arrows along the line A—A in FIG. 1.

FIG. 1 shows a front elevational view of an adhesive label in accordance with this embodiment. FIG. 2 shows a cross-sectional view taken in the direction of arrows along lines A—A in FIG. 1. In these drawings, an adhesive layer 11 is provided on one surface 10A of a label base 10 whose planar shape is formed in a substantially square shape. The adhesive layer 11 is provided in a range corresponding to the entire plane area of the label base 10. A release liner 13 having a plane area larger than that of the label base 10 is attached to the surface of the adhesive layer 11, i.e., on the side of the adhesive layer 11 opposite to the side where the label base 10 is attached.

The label base 10 is made of a translucent resin sheet. The adhesive layer 11 serves as an adhesive surface for an unillustrated adherend, and also serves as a portion onto which printing is effected directly by means of a printer of a non-contact type, such as an ink-let printer. The composition of the adhesive layer 11 in accordance with the present invention is not particularly limited, but a composition which is compatible with the composition of the ink used in the printer. For instance, in a case where the ink is made of a water soluble material, the adhesive layer 11 may be provided with a hydrophilic composition already proposed by the present applicant.

The release liner 13 is provided with slits 15 formed along a locus which forms a planar configuration slightly smaller than the planar configuration of the label base 10. These slits 15 are formed in the form of a closed loop, and serve to form the release liner 13 into two areas, i.e., an initial release-liner portion 13A and a final release-liner portion 13B located outside the sheet portion 13A.

Figure 5:
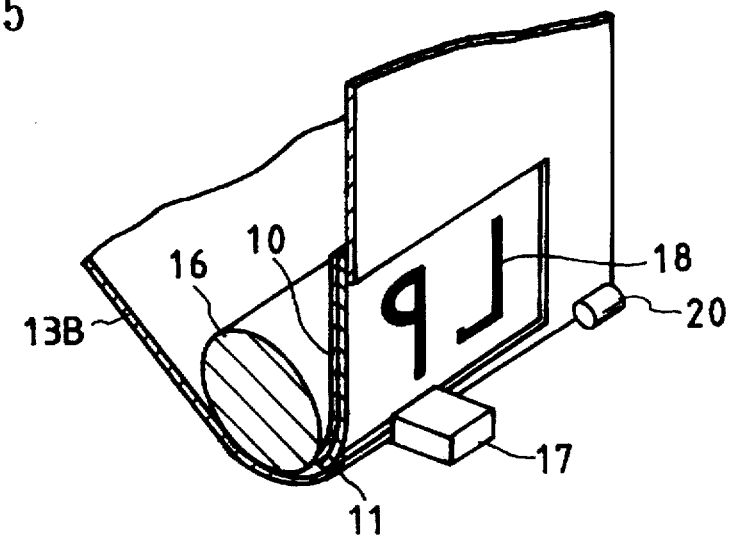
FIG. 5 is a schematic perspective view at a time when printing is effected on the adhesive label.
Figure 6:
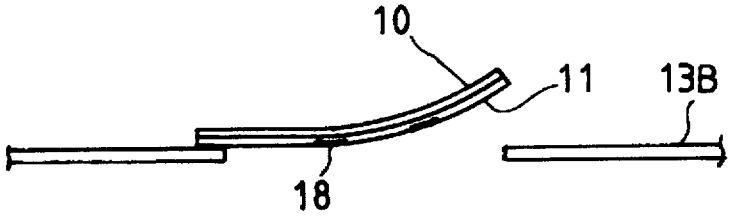
FIG. 6 is an explanatory diagram illustrating processing after printing.
Figure 7:
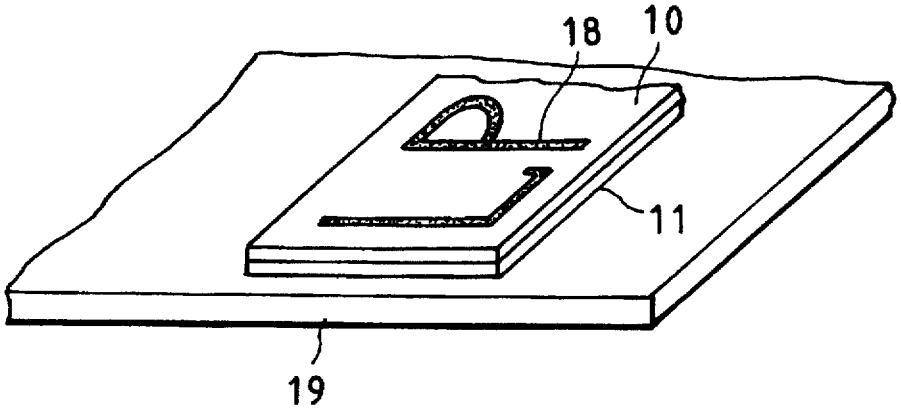
FIG. 7 is a perspective view illustrating a state in which the printed adhesive label is attached to an adherend.

Referring next to FIGS. 5 to 7 as well, a description will be given of the operation of this embodiment.

Figure 3:
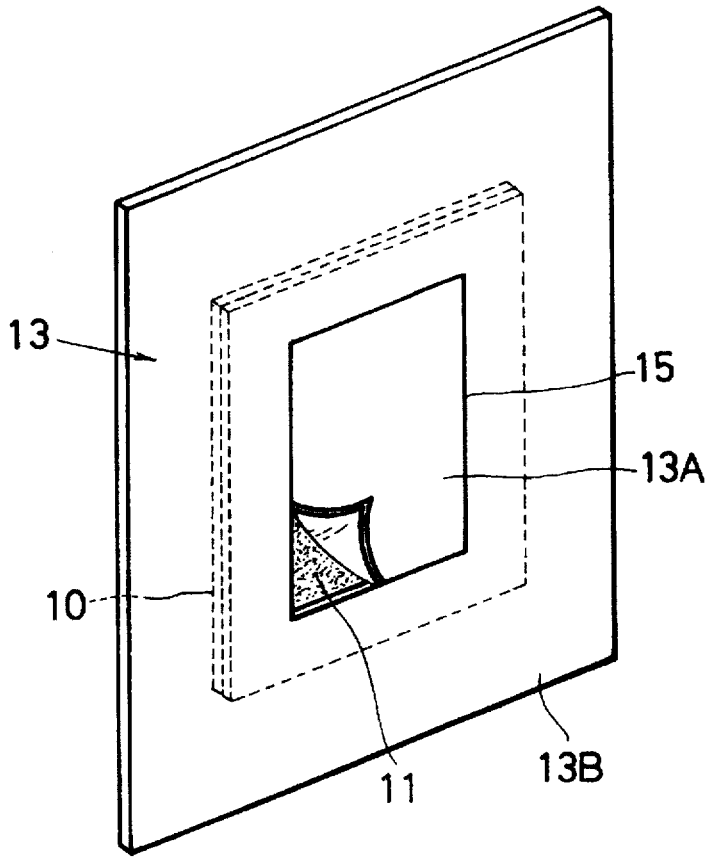
FIG. 3 is a perspective view of the adhesive label at the time when an initial release-liner portion of the adhesive label is peeled off.

In the adhesive label in an initial state, the release liner 13 is attached to the label base 10 with the adhesive layer 11 placed therebetween. Here, when printing is effected, as shown in FIG. 3, an edge of the initial release-liner portion 13A in the release liner 13 is picked up to peel off only the initial release-liner portion 13A. In this state, the adhesive layer 11 is partially exposed in the area corresponding to the initial release-liner portion 13A.

Next, the adhesive label is fed to an ink-Jet printer, i.e., a printer of a non-contact type, which prints characters or FIG. 10 inputted in advance onto the surface of the adhesive layer 11 as inverted characters or figures, as shown in FIG. 5. At this time, a platen 16 of the printer rotates while coming into contact with the label base 10 side. At the same time, feed rollers 20 provided in face-to-face relation to the platen 16 are adapted to come into contact with the final release-liner portion 13B, so that component members of the printer do not come into contact with the adhesive layer 11. Meanwhile, since a print head 17 of the ink-Jet printer is at a position spaced apart from the adhesive layer 11, the exposure of the adhesive layer 11 does not present any problem.

After the printing is completed in the above-described manner, the final release-liner portion 13B of the release liner 13 is peeled off as shown in FIG. 6, and is attached to a predetermined adherend. At this time, as shown in FIG. 7, the printed surface is located between the label base 10 and the surface of an adherend 19. Thus, when the printed surface is viewed through the surface of the label base 10, the printed characters or FIG. 18 can be visually recognized as being in a normally positioned state. Since the printed characters or FIG. 18 are protected by the label base 10, they are prevented from becoming stained or peeled off.

Accordingly, in accordance with the above-described embodiment, the slits 15 are provided in the release liner 13 to form the initial release-liner portion 13A and the final release-liner portion 13B, and the adhesive layer 11 serving as the surface for printing can be exposed by peeling off only the initial release-liner portion 13A. Hence, it is possible to obtain an advantage in that the printing on the adhesive labels of the stack sheet type by a non-contact type printer, in particular, can be effected effectively.

In addition, since the final release-liner portion 13B is left, during printing, since the feed rollers 20 are brought into contact with the final release-liner portion 13B, with the result that the component parts of the printer are prevented from coming into contact with the adhesive layer 11, thereby making it possible to effect the printing operation while securing a stable feeding state.

Figure 4A:
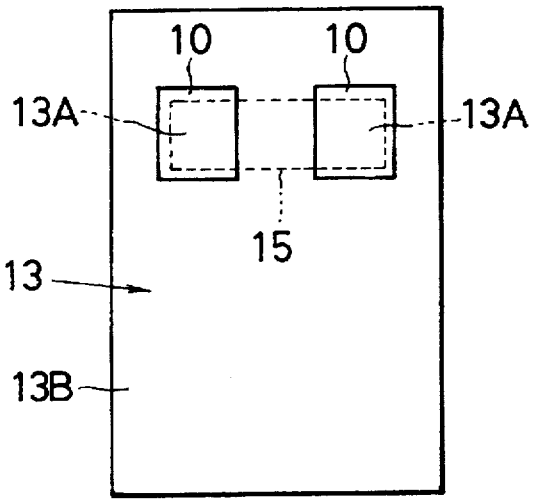
FIGS. 4(A) and 4(B) are front elevational views illustrating modifications of the adhesive label.
Figure 4B:
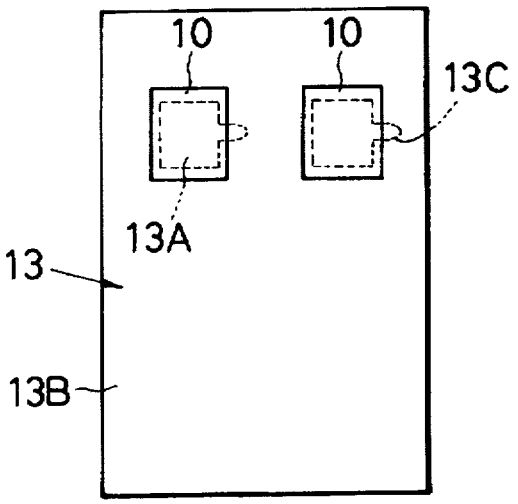

It should be noted that the adhesive label in accordance with the present invention is not limited to the above-described embodiment. For example, it is possible to adopt arrangements shown in FIGS. 4(A) and 4(B). That is, as shown in FIG. 4(A), a plurality of label bases 10 may be held on a single release liner 13, and slits 15 in the form of a closed loop may be provided in such a manner as to extend across two or more label bases 10 so as to form the initial release-liner portion 13A. According to this arrangement, it is possible to obtain an additional advantage in that a continuous printing is possible in a single peeling-off operation with respect to a plurality of label bases 10. In addition, as shown in FIG. 4(B), parts of the slits 15 may be made to project to the outside to form tongues 13C in parts of the initial release-liner portions 13A. In the arrangement in which the tongues 13C are provided, the tongues 13C can be specified as the position for starting the peeling-off, and the peeling-off can be effected easily by picking up these tongues 13C.

Figure 8:
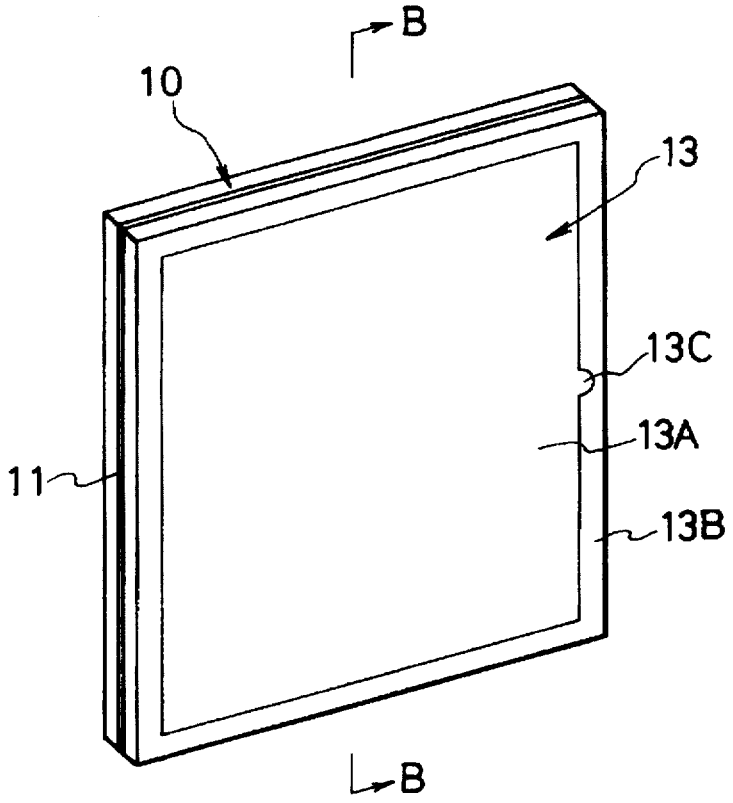
FIG. 8 is a perspective view of an adhesive label in which a release liner has a plane area equivalent to that of the label base.
Figure 9:
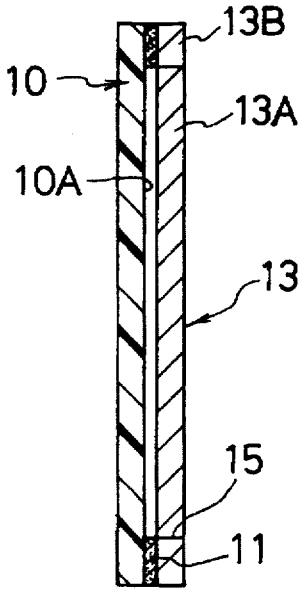
FIG. 9 is a cross-sectional view taken in the direction of arrows along the line B—B in FIG. 8.

Furthermore, although, as the release liner 13, a type having a size larger than the size of the label base 10 has been illustrated and described, the release liner 13 may be provided with a size equivalent to that of the label base 10, as shown FIGS. 8 and 9. Further, the arrangement of the adhesive layer 11 is not limited to the case where it is provided on the entire area of one surface 10A, i.e., the reverse surface, of the label base 10, and the adhesive layer 11 may be provided only on a fixed area on the outer periphery side of the label base 10. In this case, the printing is effected directly on the one surface 10A of the label base 10.

As for the aforementioned printing, it is possible to display codes indicating such as sources or nameplates, as well as a bar code for a POS system or the like. In addition, the adhesive label in accordance with the present invention can also be used as a falsification-preventing label in which the opening of the label can be detected as a strain is produced in the adhesive agent or a crack occurs in the adhesive agent layer when the label is peeled off, or as a falsification-preventing label for preventing the making of a false label.

Furthermore, in the foregoing embodiment, a description has been given of the mode in which the printed characters or the like, when viewed from the label base 10 side, can be visually recognized. However, in cases where the adherend is transparent, an arrangement may be provided such that the printed characters or the like can be visually recognized from the adherend side. In that case, the printing by the printer is effected as normally positioned characters or the like.

Since the adhesive label in accordance with the present invention is arranged and operates as described above, it is possible to provide a versatile adhesive label which offers unprecedented advantages in that it is unnecessary to use a special holding device or the like when printing, that characters, codes, or the like can be printed on the reverse surface of the label base simply and in real time without requiring a plate-making process, and that the printed surface can be projected effectively.

What is claimed is:

1. An adhesive label which can be adhered to an adherend by placing a printed surface between a surface to be applied and the adherend, said adhesive label comprising:

a label base;

an adhesive layer provided on one surface of said label base; and a release liner attached to a surface of said adhesive layer, wherein slits are formed in said release liner, and said slits form an initial release-liner portion which allows at least one of said one surface and said adhesive layer to be exposed by leaving a portion of said release liner.

2. An adhesive label according to claim 1, wherein said slits are formed continuously in such a manner as to form a closed loop.

3. An adhesive label according to claim 1, wherein a part of said slits projects outside in such a manner as to depict an arc so as to form a tongue for being picked up when said release liner is partially peeling off.

4. An adhesive label according to claim 1, wherein said release sheet has a plane area larger than that of said label base.

5. An adhesive label according to claim 1, wherein said release sheet has a plane area equivalent to that of said label base.

6. An adhesive label according to claim 1, wherein said label base is formed of a translucent resin sheet.

7. An adhesive label according to claim 1, wherein said label base is formed of one of an opaque resin sheet and a paper.

8. An adhesive label which can be adhered to an adherend by placing a printed surface between a surface to be applied and the adherend, said adhesive label comprising:

a plurality of label bases;

adhesive layers each provided on one surface of each of said label bases; and a release liner for holding in one unit said plurality of label bases respectively attached to said adhesive layers, wherein slits are formed in said release liner, and said slits form an initial release-liner portion which allows at least one of said one surface and said adhesive layer to be exposed by leaving a portion of said release liner.

9. An adhesive label according to claim 8, wherein said slits are formed continuously in such a manner as to form a closed loop, and a part of said slits is provided in such a manner as to form a tongue by depicting an arc, said tongue being used to specify a position for starting the peeling off of said release liner by picking up said tongue.

10. An adhesive label according to claim 8, wherein said slits are formed in such a manner as to extend across two or more of said label bases.

11. An adhesive label according to claim 10, wherein said slits are formed continuously in such a manner as to form a closed loop, and a part of said slits is provided in such a manner as to form a tongue by depicting an arc, said tongue being used to specify a position for starting the peeling off of said release liner by picking up said tongue.

12. An adhesive label according to claim 8, wherein each of said label bases is formed of one of a transparent sheet and an opaque sheet.

* * * * *